US005134855A

United States Patent [19]

Belcher et al.

[11] Patent Number: 5,134,855

[45] Date of Patent: Aug. 4, 1992

[54] AIR FLOW DIFFUSER WITH PATH SPLITTER TO CONTROL FLUID FLOW

[75] Inventors: Bryan L. Belcher, Leamington Spa; Arthur B. Griffin, Leicester, both of England

[73] Assignee: Rolls-Royce plc, London, England

[21] Appl. No.: 610,753

[22] Filed: Nov. 8, 1990

[30] Foreign Application Priority Data

Dec. 15, 1989 [GB] United Kingdom ..... 8928378

[51] Int. Cl.[5] ..... F02C 7/04

[52] U.S. Cl. ..... 60/751; 138/39

[58] Field of Search ..... 60/751, 759, 760, 39-36; 138/39

[56] References Cited

U.S. PATENT DOCUMENTS

| | | | |
|---|---|---|---|
| 2,541,170 | 2/1951 | Mayers et al. | 60/751 |
| 2,833,115 | 5/1958 | Clarke et al. | 60/39.36 |
| 3,756,020 | 9/1973 | Moskowitz et al. | 60/760 |
| 3,877,221 | 4/1975 | Lefebvre et al. | 60/751 |
| 4,168,609 | 9/1979 | Greenberg et al. | 60/39.36 |
| 4,194,359 | 3/1980 | Brookman et al. | 60/751 |
| 4,232,710 | 11/1980 | Gallo et al. | 138/39 |
| 4,297,842 | 11/1981 | Gerhold et al. | 60/760 |
| 4,704,869 | 11/1987 | Iizuka et al. | 60/760 |
| 4,919,170 | 4/1990 | Kallinich et al. | 138/39 |

FOREIGN PATENT DOCUMENTS

| | | | |
|---|---|---|---|
| 866878 | 2/1953 | Fed. Rep. of Germany | 60/759 |
| 940195 | 10/1963 | United Kingdom | 60/751 |

*Primary Examiner*—Richard A. Bertsch
*Assistant Examiner*—Timothy S. Thorpe
*Attorney, Agent, or Firm*—Cushman, Darby & Cushman

[57] ABSTRACT

A diffuser for use in a gas turbine engine comprises an inner and an outer annular wall which define a divergent flow passage. The divergent flow passage is divided by a splitter to form two annular flow ducts, of different flow area. Introduction of the splitter into the diffuser to form the two annular flow ducts enables the length of the outer annular wall of the diffuser to be reduced. Reducing the length of the outer annular wall of the diffuser increases the flow area between the diffuser and combustion chamber. Air downstream of the diffuser is therefore unrestricted and moves radially outward to the ports in the head of the combustion chamber with minimum pressure loss.

6 Claims, 3 Drawing Sheets

AIR FLOW DIFFUSER WITH PATH SPLITTER TO CONTROL FLUID FLOW

FIELD OF THE INVENTION

This invention relates to a diffuser and in particular to a diffuser for use in a gas turbine engine.

BACKGROUND OF THE INVENTION

Diffusers convert a high velocity, low pressure fluid flow into a low velocity, high pressure fluid flow. A particular application of diffusers is in gas turbine engines in which air from downstream of a compressor passes through a diffuser into a combustion chamber. The diffuser comprises an annular divergent passage which acts to decelerate the air from the compressor and raise its static pressure by converting its kinetic energy into pressure energy. The air then enters the combustion chamber at a velocity which enables combustion to be substained.

For gas turbine engines used in industrial applications where low emissions of nitrogen oxides are to be achieved the combustion chamber consists of multiple chambers disposed in an annular array around the engine axis and which due to their length are inclined outward with respect to the axis of the engine. Air from the outlet of the diffuser has to double back upon itself to reach the head of each of the combustion chambers. A problem with this sort of arrangement is that the diffuser extends so far down the combustion chamber that the majority of the air is severely restricted and substantial pressure losses occur. The flow of air to the combustion chamber is restricted and interacts with the flow entering the diffuser. The interaction of these flows causes the diffuser performance to deteriorate.

SUMMARY OF THE INVENTION

The present invention seeks to provide a diffuser which provides adequate flow area between the diffuser exit and the combustion chambers. The diffuser flow is split in the most advantageous ratio to maximise flow area ratios and minimise interaction of the flow at the downstream end of the diffuser with the flow through the diffuser.

According to one embodiment of the present invention, a duct comprises at least two walls which are divergent in the direction of fluid flow through the duct, and a splitter of given length disposed between the at least two walls so that it is closer to one of the walls than the other to define a plurality of unequal flow passages, the wall closer to the splitter having a length which is less than the length of the splitter.

Preferably the wall further from the splitter is of a length equal to or greater than the length of the splitter.

In a further embodiment of the present invention at least one further splitter of given length is disposed between the at least two walls to define at least one further duct for fluid flow, the at least one further splitter being of greater length than the wall or splitter which it is closest thereto.

Preferably the two walls and the splitter are annular, the annular splitter is disposed between the two annular walls to define two unequal annular flow passages. The two annular flow passages may have inlet areas in the ratio 3:1.

The duct is preferably for use in a gas turbine engine.

BRIEF DESCRIPTION OF THE DRAWINGS

The invention will now be described by way of example and with reference to the accompanying drawings in which.

DETAILED DESCRIPTION OF THE INVENTION

Figure 1:
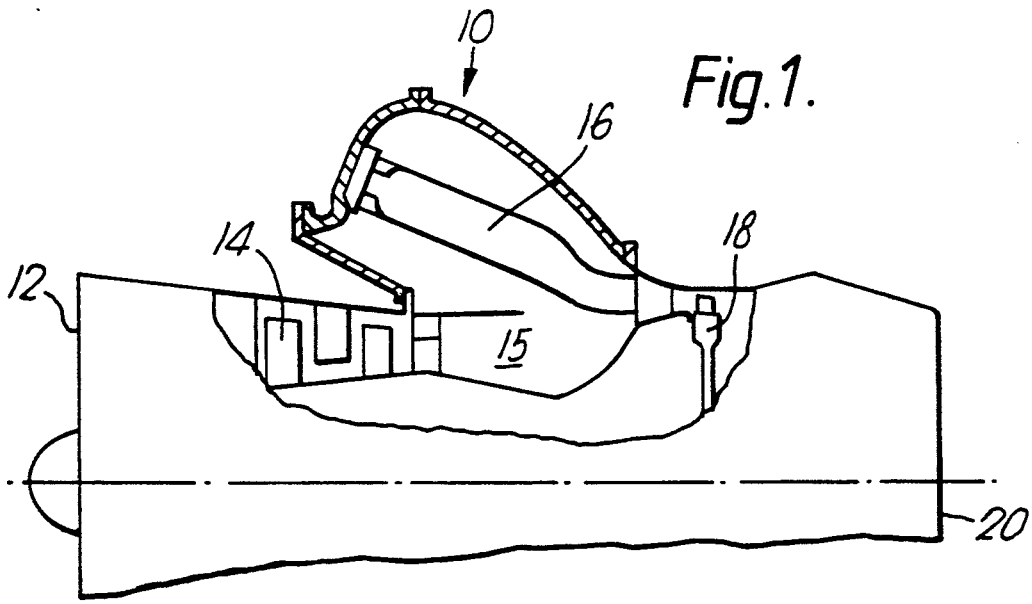
FIG. 1 is a part cut away diagrammatic view of a gas turbine engine, incorporating a diffuser which is not in accordance with the present invention.

With reference to FIG. 1, a gas turbine engine generally indicated at 10 comprises in axial flow series, an air intake 12, an axial flow compressor 14, combustion equipment 16, turbine 18 and an exhaust nozzle 20. The engine functions in the conventional manner whereby air is drawn through the air intake 12 and is compressed in the compressor 14. The compressed air then passes through a diffuser 15 where its velocity is decreased and its pressure increased before being mixed with fuel and passed into the combustion equipment 16 for combustion. The products of combustion then expand through and rotate the turbine 18, which drives the compressor 14, before being exhausted through the exhaust nozzle 20.

Figure 2:
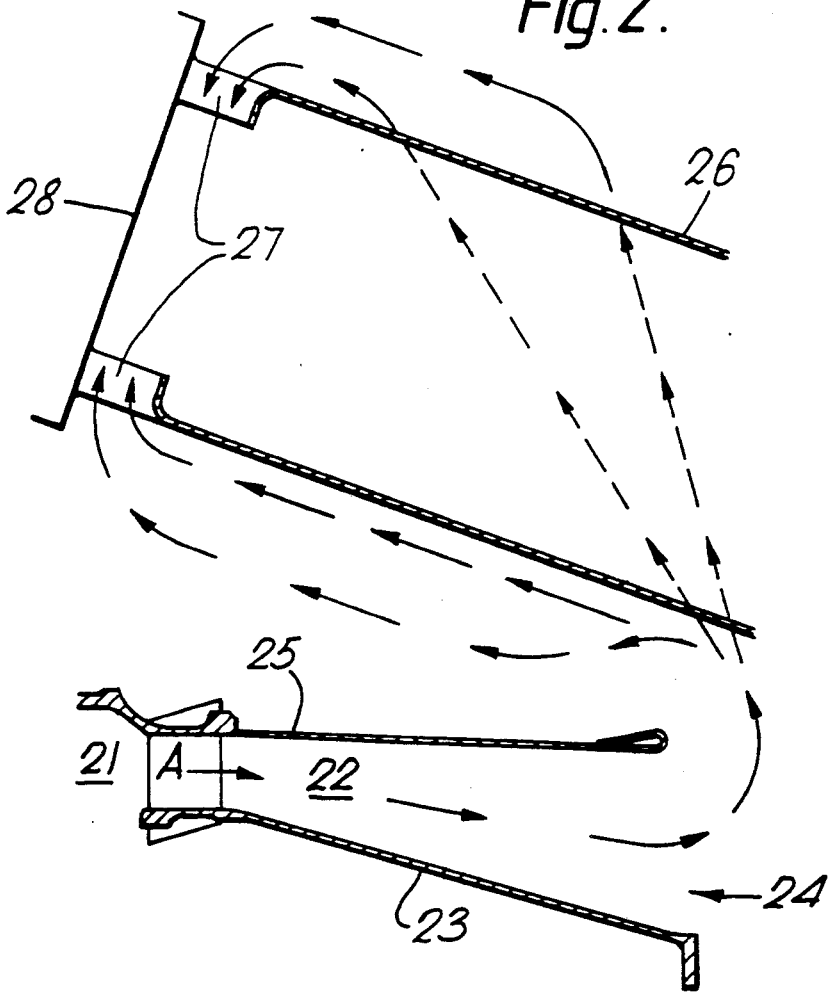
FIG. 2 is a sectioned side view of a combustor chamber and a diffuser not in accordance with the present invention.

The combustion equipment 16 consists of an annular array of combustion chambers which due to their length are inclined to the axis of the engine 10. FIG. 2 shows a sectioned view of one of the combustion chambers 26 and a diffuser 24 which is not in accordance with the present invention. With this arrangement compressed air passes from the compressor outlet 21, through the diffuser 24 to the combustion chamber 26. The diffuser comprises an inner 23 and an outer 25 annular wall which define a divergent flow passage 22 through which the compressed air flows in a direction indicated by arrows A. As the air passes through the divergent flow passage 22 its velocity or kinetic energy decreases whilst its pressure energy increases. The diffused air then passes from the diffuser 24 to the upstream end of the combustion chamber 26 through entry ports 27 at the head 28 of the combustion chamber 26. As the combustion chamber 26 is inclined to the axis of the engine 10, the air on passing downstream of the diffuser 24 must double back upon itself and travel radially outwards towards the ports 27 in the head 28 of the combustion chamber 26. The length of the diffuser 24 however, is such that there is limited area through which the airflow can travel to reach the combustor head 28. The area for the airflow downstream of the diffuser 24 returning to the combustion chamber head 28 is thus severely restricted and results in substantial pressure losses occurring.

Figure 3:
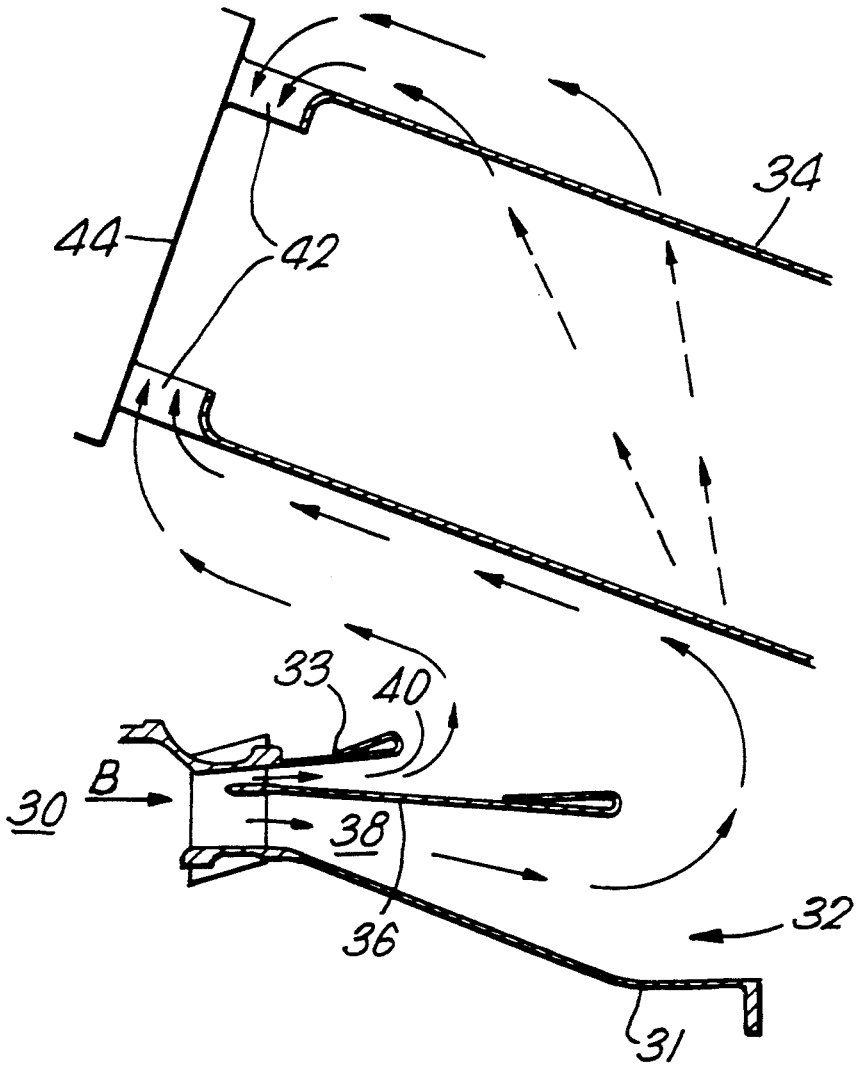
FIG. 3 is a sectioned side view of a combustor chamber and a diffuser in accordance with the present invention.

The present invention shown in FIG. 3, provides a diffuser 32 which provides adequate flow area between the diffuser 32 and a combustion chamber 34 and minimises interaction of the flow restricted at downstream end of the diffuser with the flows passing through the diffuser. Compressed air passes in a direction shown by arrows B from a compressor outlet 30, through the diffuser 32 to the combustion chamber 34. The diffuser 32 comprises a radially inner annular wall 31 and a radially outer annular wall 33 between which is disposed an annular splitter 36. The annular splitter 36 is coaxially disposed between the inner 31 and outer 33 annular wall in an offset position so that the splitter 36 is closer to the outer wall 33. The offset position of the annular splitter 36 defines two unequal annular flow ducts 38 and 40.

In operation the annular splitter divides the flow from the compressor outlet 30 into the two flow ducts 38 and 40. The flow is divided into a 3:1 ratio, 75% of the flow is diffused through the annular flow duct 38, whilst the remaining 25% is diffused through the annular flow duct 40.

Introduction of the splitter 36 into the diffuser 32 enables the length of the outer wall 33 to be significantly reduced and the inner wall 31 by 25%. The length of the outer wall 33 of the diffuser 32 is proportional to the height of the inlet to flow duct 40 adjacent the outer wall 33 for a given area ratio. The area ratio being the area to the outlet of the diffuser 32 divided by the area of the diffuser inlet.

In the arrangement shown in FIG. 3 the outer wall 33 is reduced to approximately one quarter of its original length shown in FIG. 2.

Reduction of the length of the outer annular wall 33 of the diffuser 32 provides increased flow area between the end of the outer wall 33 and the combustion chamber 34. The airflow downstream of the diffuser 32 which flows radially outward to the ports 42 at the head 44 of the combustion chamber 34 is therefore unrestricted and suffers minimum pressure losses.

Figure 4:
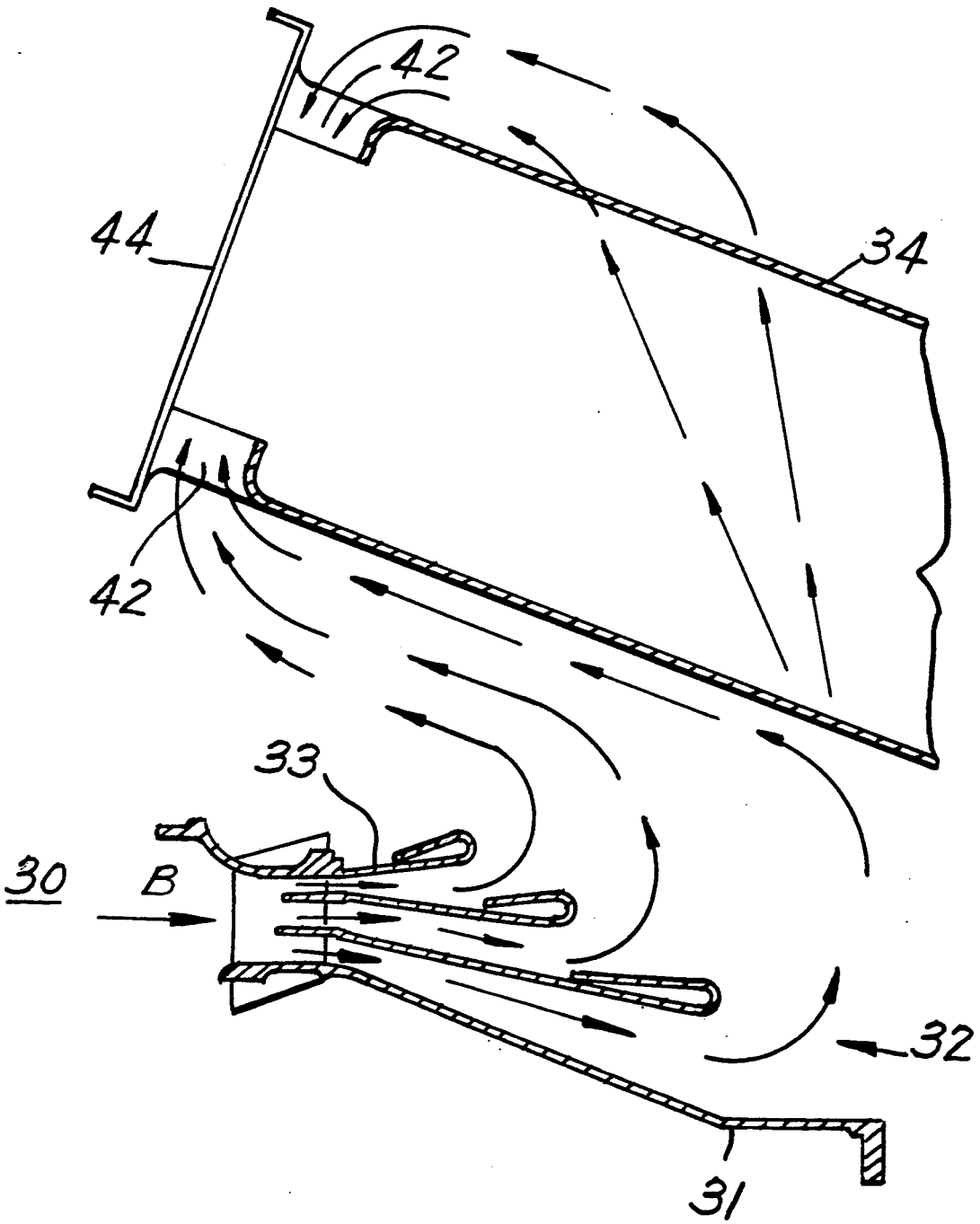
FIG. 4 is a view similar to FIG. 3 but showing the use of a further splitter in the differ of the present invention.

FIG. 4 illustrates a further embodiment of the present invention where a further splitter is inserted having a length greater than the splitter placed closest to the shorter wall of the two walls of the diffuser.

It will be appreciated by one skilled in the art that experiments will determine the optimum position of the splitter to give a diffuser of the required length for a particular application.

We claim:

1. A diffuser comprising at least two walls which define a duct therebetween through which, in operation, a flow of fluid passes, said duct having an inlet and an outlet, the flow of fluid passing in a direction from the inlet to the outlet of said duct, said two walls being divergent in the direction of fluid flow through said duct, a splitter having a selected length extending in the direction of the fluid flow and being disposed between said two walls to define together with said walls a first divergent flow passage having a first inlet and a second divergent flow passage having a second inlet, said splitter being located between said two walls closer to one of said walls than the other of said walls with said inlet to said duct comprising a first and a second inlet with the cross-sectional area of the first inlet to the first flow passage being different from the cross-sectional area of the second inlet to the second flow passage, said wall closest to said splitter having a length in the direction of fluid flow which is less than the length in the direction of fluid flow of said splitter.

2. A duct as claimed in claim 1 in which the wall further from the splitter is of a length equal to the length of the splitter.

3. A duct as claimed in claim 1 in which the two walls and the splitter are annular, the annular splitter is disposed between the two annular walls to define first and second annular flow passages.

4. A diffuser as claimed in claim 1 in which a further splitter of selected length in the direction of fluid flow is disposed between said two walls to define at least one further divergent flow passage, said further splitter being of greater length in the direction of fluid flow than one of said walls and splitter which is closest thereto.

5. A diffuser as claimed in claim 1 in which the ratio of the cross-sectional areas of said first and second inlets is 3:1.

6. A gas turbine engine including a diffuser comprising at least two walls which define a duct therebetween through which, in operation, a flow of fluid passes, said duct having an inlet and an outlet, the flow of fluid passing in a direction from the inlet to the outlet of said duct, said two walls being divergent in the direction of fluid flow through said duct, a splitter having a selected length extending in the direction of the fluid flow and being disposed between said two walls to define together with said walls a first divergent flow passage having a first inlet and a second divergent flow passage having a second inlet, said splitter being located between said two walls closer to one of said walls than the other of said walls with said inlet to said duct including said first and second inlet with the cross-sectional area of the first inlet to the first flow passage being different from the cross-sectional area of the second inlet to the second flow passage, said wall closest to said splitter having a length in the direction of fluid flow which is less than the length in the direction of fluid flow of said splitter.

* * * * *